United States Patent [19]

Jahnke et al.

[11] Patent Number: 4,694,868

[45] Date of Patent: Sep. 22, 1987

[54] APPARATUS FOR MANUFACTURING A DISC-SHAPED CURVED MAGNET COIL

[75] Inventors: Andreas Jahnke, Forchheim; Günter Ries; Konrad Meier, both of Erlangen, all of Fed. Rep. of Germany

[73] Assignee: Siemens Aktiengesellschaft, Munich, Fed. Rep. of Germany

[21] Appl. No.: 805,331

[22] Filed: Dec. 5, 1985

[30] Foreign Application Priority Data

Dec. 10, 1984 [DE] Fed. Rep. of Germany ..... 3444983
Aug. 19, 1985 [DE] Fed. Rep. of Germany ..... 3529607

[51] Int. Cl.[4] ..... H01F 41/00

[52] U.S. Cl. ..... 140/92.1; 29/423; 29/605; 29/745; 29/761; 242/7.06; 242/118

[58] Field of Search ..... 29/605, 745, 761, 423; 242/7.06, 7.07, 1, 7.03, 118; 336/208, 225; 140/92.1

[56] References Cited

U.S. PATENT DOCUMENTS

| | | | |
|---|---|---|---|
| 3,721,400 | 3/1973 | Weissman | 242/118 |
| 4,085,603 | 4/1978 | Vanek | 29/605 X |
| 4,399,949 | 8/1983 | Penn et al. | 242/1 |
| 4,547,962 | 10/1985 | de Walle et al. | 29/606 |

*Primary Examiner*—Carl E. Hall
*Attorney, Agent, or Firm*—Kenyon & Kenyon

[57] ABSTRACT

A method for manufacturing a disc-shaped curved magnet coil, particularly for a system for accelerating and/or storing electrically charged particles such as electrons. The conductors of the coil to be made are to be arranged around a winding core having a convex outside and a concave inside and are then to be fixed in position around the winding core. A coil form or fitting piece of predetermined shape is first added to a winding core, so that a provisional winding body with only positive radii of curvature on its outsides is formed. The conductors are wound under tension around the winding body and subsequently are fastened only to the winding core of the winding body and, after the coil form is removed, the thus exposed conductor portions facing the region of the concave inside of the winding core are pressed against this inside and fixed in position.

15 Claims, 4 Drawing Figures

APPARATUS FOR MANUFACTURING A DISC-SHAPED CURVED MAGNET COIL

BACKGROUND OF THE INVENTION

The present invention relates to a method for manufacturing a disc-shaped curved magnet coil, especially for a system for accelerating and/or storing electrically charged particles such as electrons, wherein the conductors of the coil to be manufactured are arranged about a winding core having a convex outside and a concave inside and therefore, with a partially negative curvature, and are thereupon fixed in their appropriate position. The invention further relates to apparatus for implementing this method.

Such a magnet coil is known, for instance, from the publication "Fuji Electric Review", vol. 19, No. 3, 1973, pages 112 to 118. This coil, wound of superconductors, is curved along an arc length with predetermined radius and predetermined arc (sector) angle, so that it has a convex outside and a concave inside. The magnet coil, the conductors of which are secured by struts between these sides in their geometric position, is to serve as a lifting magnet for the contactless suspension guidance of a vehicle along a track.

Also in particle accelerators, storage rings for charged particles such as electrons must have appropriately curved dipole magnets due to their curved particle tracks. These magnets can be bent, in particular, in the shape of semicircles (see, for instance, "IEEE Trans. on Nucl. Sci.", vol. NS-30, No. 4, August 1983, pages 2531 to 2533.) Because of the required high field intensity, superconducting windings are provided preferably for this purpose (see, for instance, also "Technical Report of ISSP"-the Institue for Solid State Physics-the University of Tokyo, Japan - Ser. B, No. 21, September 1984, pages 1 to 29).

In order to guarantee an unchanged position of the turns of these windings to be fabricated from appropriate conductors, they must first be wound about an appropriately formed winding core and fastened to the latter. The problem arises, however, of winding a coil with a negative radius of curvature in the region of the concave insides of such winding cores.

Magnets, the windings of which have negative curvature, can be manufactured, for instance, by laying at least one conductor in slots without tension and subsequent wedging. Also known in successive clamping of the conductor, using special contacting elements such as individual clamps on the outside rim of an appropriately shaped winding core in fixed relationship. The conductor sections clamped-on by these elements must then be fixed section by section on the winding core or, if necessary, on conductor turns already applied to them, for instance, by cementing. Such winding techniques, however, are very elaborate and time-consuming, especially for the manufacture of superconducting dipole magnets of storage rings.

SUMMARY OF THE INVENTION

It is therefore an object of the present invention to provide a method, by which the manufacture of disc-shaped curved magnet coils is made possible in a relatively simple manner on a large technical scale where particularly superconducting conductors are to be provided.

The above and other objects of the present invention are achieved by the provisions that a formed body of predetermined shape is first attached to the winding core, so that a provisional winding body with only positive radii of curvature of its outsides and at least approximately the same outside circumference as the winding core is formed; that then the conductors are wound around this coil form under tension and subsequently are fastened only to the winding core of the winding body (coil form); and that, after the forming body is removed, the thus exposed conductor portions facing the region of the concave inside of the winding core are pressed against this inside and fixed in position.

The advantages connected with this embodiment of the method are in particular that the winding body composed of the winding core and the formed body has only positive radii of curvature so that the individual conductor can be wound around the same under tension without difficulty. The concave inside of the coil to be fabricated is then obtained by the provision that after the formed body is removed, the corresponding long side of the curved winding is formed by pressing the conductors on this side against the concave inside of the winding core. In this relatively simple manner, a coil with negative curvature can thus be manufactured without the need of a separate, generally very elaborate fixation of all the turns during the winding process.

The method according to the invention can advantageously be carried out with apparatus, for which an approximately lens-shaped fitting piece is provided for the concave inside which can be attached in a form-locking manner. With such a formed piece, a particularly simple design of the provisional coil form is possible.

A further device for carrying out the method according to the invention contains a composite formed body which comprises at least two formed parts adjoining the heavily curved end pieces of the winding core and at least one connecting part extending between these formed parts, where the transition from the convex outside of the winding core to the respective formed part of the coil form is located a predetermined distance from the corresponding end piece of the winding core, and where a heavier curvature of the formed parts is provided in predetermined regions, so that, after the provisional winding about the coil form is made, the formed body is removed and the thus free winding parts, which previously were resting against the more heavily curved regions of the formed parts are located at least approximately at the heavily curved ends of the winding core are pressed against the concave inside of the winding core. In this manner, mutual motions of the conductors and thereby, nonuniform stretching can be limited to a minimum.

Other objects, features and advantages of the present invention will be apparent from the detailed description which follows.

BRIEF DESCRIPTION OF THE DRAWINGS

The invention will be explained in greater detail in the following detailed description with reference to the drawings, in which.

DETAILED DESCRIPTION

Figure 1:
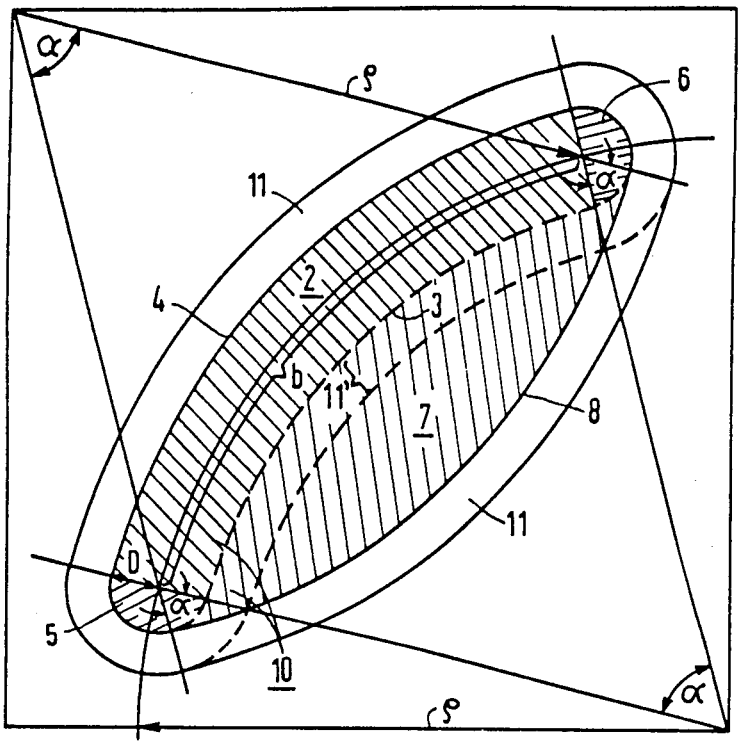
FIG. 1 shows the manufacture of a curved, disc-shaped magnet coil with a device suitable therefor.

With reference now to the drawings, FIG. 1 shows schematically, in a top view, a flat winding core 2 such as can be provided, for instance, for making a flat dipole magnet coil for an electron storage ring. The winding of the coil must be made with at least one flat and, in particular, superconducting conductor. The winding core 2 which extends along a predetermined length of arc b with an arc or curvature radius $\rho$, has a constant width of $2\times D$. The quantity D is here the distance from the arc line b to the two concentrically curved long sides 3 and 4 of the winding core 2. This constant width of the winding core extends over a length of arc $\pi\alpha^\circ\rho/180^\circ$, where $\alpha^\circ$ is the sector or arc angle measured in degrees. The end pieces 5 and 6 of the winding core 2 at the end faces are formed by semicircles with diameters of $2\times D$ each. Via these semicircles, the convex outside 4 which is to be wound is therefore connected to the concave inside 3 of the winding body 2.

Prior to the winding operation proper an approximately lens-shaped fitting piece 7 is added in a form-locking manner to this concave inside 3 of the winding core 2 as a formed body which has the height of the conductor to be wound and the outside 8 of which is to be wound, and rests tangentially against the end pieces 5 and 6 at the end faces of the winding core 2. This fitting piece has therefore, on the side facing the winding core 2, a radius of curvature of $\rho-D$ over a length of arc $(\pi/180)\alpha(\rho-D)$. This part of the fitting piece is further followed on both sides by circular arcs with the radius of curvature D and the arc angle $\alpha$. The outside 8 of the fitting piece 7 to be wound has preferably a radius of curvature $\rho+D$ and likewise an arc angle $\alpha$.

On the winding body (coil form) 10 formed by the winding core 2 and the fitting piece 7, the coil conductors 11 are then wound under tension to form a winding packet of constant width, the same spacing being maintained between the individual conductor turns. Since the radii of curvature are always positive, there is no danger, advantageously, that the conductors 11 which are bent with a radius of curvature D at the end pieces 5 and 6 might unravel at the end faces. After the winding produced in this manner is fastened only at the coil core 2, for instance, by clamping, the fitting piece 7 can be reduced in size and removed. Subsequent pressing of the conductor portions located in the region of the thus free concave inside 3 of the winding core 2 against this long side then takes place in such a manner as if each turn individually were resting against the winding core 2 with a matching length. Due to the predetermined radius of curvature of the outside 8 of the fitting piece 7 to be wound, it is assured that the conductor lengths in the individual turns remain at least largely constant before and after the pressure is applied and thus an upsetting or overstretching of the conductor is avoided. In the figure, the pressed-on conductor portions are designated with 11' and indicated by dashed lines. Loosening the clamps holding the winding at the winding core is therefore not necessary. Since the fitting pieces have exactly the height of the conductors of the turns, also double discs can advantageously be wound successively. Superconducting dipole magnet coils are generally built up from such double discs.

According to the embodiment of FIG. 1, it was assumed that the coil form comprises always only one fitting piece 7 for each disc-shaped winding and the conductors lie against each other in a form-locking manner at the end pieces 5 and 6 of the winding core 2 at the end faces. However, as can be seen from the schematic top view shown in FIG. 2, of a further embodiment of a magnet coil that can be manufactured according to the invention, the conductor can also be made thinner at the ends of the coil at the end faces. Corresponding to the method described in connection with FIG. 1, a winding section 15, 15' is first built up for this purpose around a central curved winding core 2, using an approximately lens-shaped fitting piece 7.

To this finished, curved partial winding, half-moon-shaped fitting pieces 18 and 19 are then added in a form-locking manner in the region of their end face ends **15*a* and 15*b*. These fitting forms represent, together with the winding core 2 and the winding sections 15, 15' arranged around the latter, a further, larger and likewise curved winding core, against which a further approximately lens-shaped fitting piece is put in accordance with the method of the invention so that in this manner a larger winding body with only a positive curvature of its long sides is obtained. This larger winding body is wound just like in the first winding section. The larger winding section so obtained, which surrounds the first winding section 15, 15' is designated with 16, 16' in the figure. In a similar manner, further winding sections can subsequently be made. According to the embodiment shown, a third winding section 17, 17'** is assumed. A presentation of the further (larger) fitting pieces and fitting forms has been dispensed with in the figure for reasons of clarity.

As shown particularly in FIG. 1, the embodiments are based on curved winding cores, the sector or arc angles $\alpha$ of which are chosen smaller than 90°. However, the method according to the invention is not limited to coil forms with arc angles up to this size. Similarly, curved winding cores with arc angles up to 180° can rather be wound also. In the case of $\alpha=180^\circ$, the coil form and the fitting pieces can then form together, for instance, an approximately circular coil form.

Figure 2:
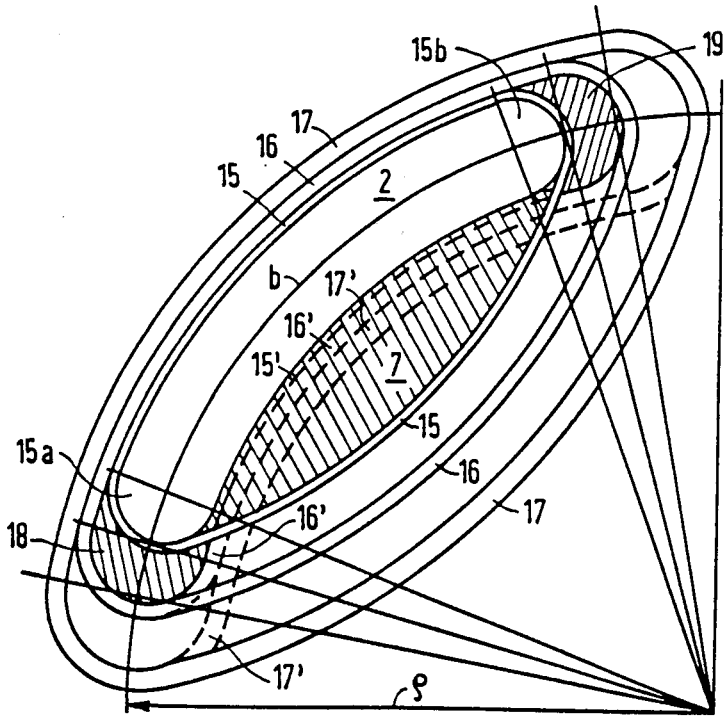
FIG. 2 shows schematically a specific embodiment of a corresponding magnet coil.

In the embodiments shown in FIGS. 1 and 2, of disc-shaped magnet coils which can be manufactured according to the invention, it was further assumed that each of the fitting pieces have, on their outside to be woumd, a radius of curvature which is determined by the radius of curvature of the length of arc of the central winding core, the width of which is determined by its arc angle. Optionally, however, the outside of these fitting pieces to be wound can have also a shape with different curvature. The only condition for this is that no negative radii of curvature are obtained and the length of the outside to be wound of the fitting piece is chosen so that the conductor lengths in the individual turns before and after the pressing-on operation are at least largely constant. An embodiment of a corresponding form body is shown in FIG. 3.

Figure 3:
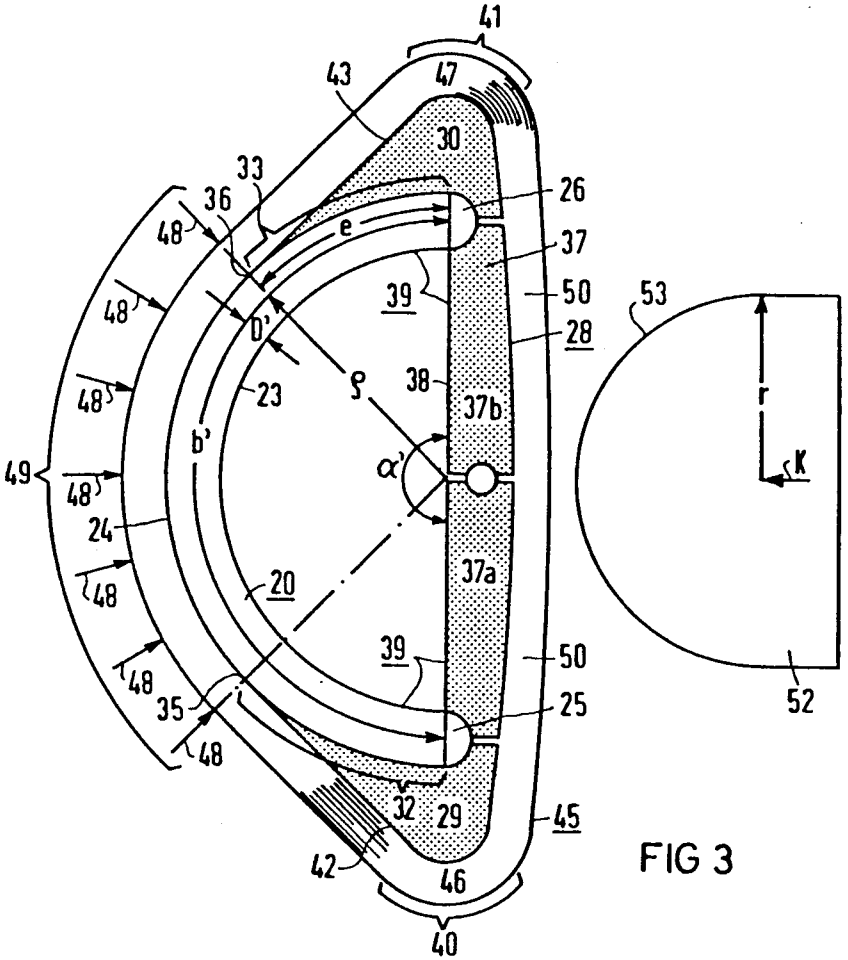

From FIG. 3, a flat winding core 20 is shown schematically in a top view which is to be provided with a winding by the method according to the invention. The winding core 20 which extends along a predetermined length of part b' with an arc or curvature radius $\rho'$, has a constant width of $2\times D'$ between its two concentrically-curved long sides 23 and 24. According to the embodiment shown, the sector or arc angle $\alpha'$ is to have a value of 180°. The end pieces 25 and 26 of the winding core 20 at their end faces are formed by semicircles with diameters of $2\times D'$ each.

Prior to the winding operation proper, a coil form 28 is added, according to the invention, to the winding core 20, which can be assembled from several pieces. This coil form comprises two outer formed parts 29 and 30 which can be put substantially onto the convex outside 24 in regions 32 and 33 adjoining the end pieces 25 and 26, where they rest tangentially against the winding core 20 at transition points 35 and 36, respectively. These outer formed parts 29 and 30 are assembled with a single- or multiple-pipe connecting part 37 (37*a* and 37*b*) extending between them on the side facing the concave inside 23 of the winding core 20 to form the coil form 28. The connecting part 37 can have any desired shape on its inside 38 and can rest, for instance, against the inside 23 of the winding core 20. In the embodiment shown, a plane shape is assumed. Together with the winding core 20, the coil form now forms a provisional winding body 39 with only positive radii of curvature of its outsides, where its outside circumference should advantageously be equal, at least approximately, to the outside circumference of the winding core 20.

The transition points 35 and 36 between the winding core 20 and the outer formed parts 29 and 30 are advantageously at a predetermined distance e from the respective end pieces 25 and 26. According to the embodiment shown, it is assumed that e amounts to a length of arc which corresponds to about $\frac{1}{4}$ of the arc length b', i.e., $e=(b'/4)+(\pi[\alpha'/4].D')/18020$ . In addition, the formed parts 29 and 30 are designed advantageously in such a manner that they always have a more heavily curved region 40, 41 of their outsides 42, 43 at a predetermined point. The location of these regions is determined by the provision that, after the winding body 39 is wound with a provisional winding 45, the winding parts 46, 47 adjacent to these regions rest at first, in the finally produced curved winding, at least approximately against the regions of the heavily curved end pieces 25 and 26 of the winding core 20.

In order to convert the provisional winding 45 into the desired final form, their winding part is pressed in the region 49 of the unchanged winding core 20 against the latter, as is to be indicated in FIG. 3 by lines 48 with arrows, or is fastened to the latter, for instance, by clamping. After the added pieces 29, 30, 37 of the coil form 28 have been removed, the thus freed conductor parts 50 of the provisional winding 45 are then pressed by means of a specially formed pressure piece 52, to the concave inside of the winding body 20 with a force K. Due to the predetermined outside circumference of the coil form 28, it is then assured that the conductor lengths in the individual turns remain, at least largely, constant before and after the pressing-on and that in this manner an upsetting or overstretching of the conductors is avoided.

Figure 4:
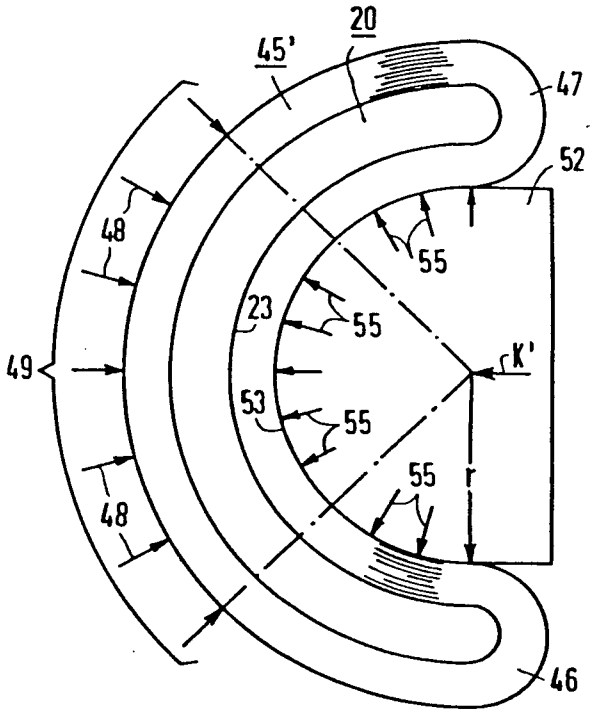
FIGS. 3 and 4 show schematically a further device for carrying out the method according to the invention during different portions of the process. Like parts are provided in the figures with the same reference symbols.

The winding deformed in this manner is illustrated schematically in FIG. 4 as a top view and is designated with 45'. In the region of the concave inside 23 of the winding core 20, the winding is held in a lock-fitting manner by the pressure piece 52 because of a holding force K' at this inside. To this end, the pressure piece 52, as shown in particular also from this figure, must have a curved outside 53 which deforms the winding, and the radius of curvature r of which is fitted to the winding and therefore to the radius $\rho'$ of the winding core 20. I.e., the following relation applies approximately: $r=\rho'-D'-s$, where s is the radial dimension of the winding 45' on the concave inside 23 of the winding core 20.

After the winding 45 is pressed on, the latter can then be solidifed by means of a hardenable plastic. As indicated further in FIG. 4 by lines 55 with arrows, the conductor parts adjacent to the concave inside 23 of the winding core 20 can further be fastened or, for instance, clamped after the pressure plece 52 is removed.

Also, the coil form 28 with its formed parts 29 and 30 as well as with the connecting part 37 can have exactly the height of the conductors of the turns to be produced, so that double discs can thereby be wound consecutively.

In the foregoing specification, the invention has been described with reference to specific exemplary embodiments thereof. It will, however, be evident that various modifications and changes may be made thereunto without departing from the broader spirit and scope of the invention as set forth in the appended claims. The specification and drawings are, accordingly, to be regarded in an illustrative rather than a restrictive sense.

What is claimed is:

1. Apparatus for manufacturing a disc-shaped curved magnet coil, for a system for at least one of accelerating and storing electrically charged particles, wherein the conductors of the coil to be made are arranged about a winding core which is curved along a central arc length (b) with at least approximately constant spacing (2D) between long sides thereof having a curvature and wherein said conductors are fixed in position about the winding core, comprising an approximately lens-shaped fitting piece as a coil form added to the concave inside of the winding core so as to form a provisional winding body with only positive radii of curvature on outsides thereof, the conductors being wound under tension about said provisional winding body and subsequently fastened only to the winding core of the winding body, said coil form being removable whereby the exposed conductor portions facing the region of the concave inside of the winding core may be pressed against the concave inside and the conductor portions fixed in position against the concave inside of the winding core.

2. The apparatus recited in claim 1 further comprising semicircular end pieces at the end faces thereof.

3. The apparatus in claim 2, wherein the approximately lens-shaped fitting piece has, on a side facing the winding core, a radius of curvature $\rho-D$ for an arc length of $(\pi/180°)\alpha(\rho-D)$ and has, on an outside to be wound, a radius of curvature $\rho+D$, where:

$\rho$ is the radius of curvature of the central arc length (b) of the winding core;

$\alpha$ is the arc angle of the arc length (b); and

D is the radius of the end pieces at the end faces.

4. The apparatus recited in claim 2, wherein the outside circumference of the provisional winding body is at least approximately equal to the outside circumference of the winding core.

5. The apparatus recited in claim 2, wherein the winding of the magnet coil is made with superconducting conductors.

6. The apparatus recited in claim 2, wherein the magnet coil comprises at least one flat winding.

7. The apparatus recited in claim 2, wherein the magnet coil comprises a plurality of flat windings.

8. Apparatus for manufacturing a disc-shaped curved magnet coil, for a system for at least one of accelerating and storing electrically charged particles wherein the conductors of the coil to be made are arranged about a winding core which has a convex outside and a concave inside and thus with a partially negative curvature and which are fixed in position about the winding core, comprising a coil form of predetermined shape added to the winding core so as to form a provisional winding body with only positive radii of curvature on outsides thereof, the conductors being wound under tension about said provisional winding body and subsequently fastened only to the winding core of the winding body, said coil form being removable whereby the exposed conductor portions facing the region of the concave inside of the winding core may be pressed against the concave inside and said conductor portions fixed in position against the concave inside of the winding core, said coil form comprising a composite coil form having at least two shaped parts adjoining curved end pieces of the winding core and at least one connecting part extending between said shaped parts, a transition from the convex outside of the winding core to the respective shaped part of the coil form being spaced by a predetermined distance (e) from the corresponding end piece of the winding core, the curvature of the outsides of the shaped parts being greater in predetermined regions than the curvature of corresponding regions of the winding core, so that after a provisional winding is wound around the winding body, the coil form may be removed and the thus exposed winding portions may be pressed against the concave inside of the winding core, the winding portions which previously were adjacent to the curved predetermined regions of the shaped parts being located at least approximately at the curved end pieces of the winding core.

9. The apparatus recited in claim 6 wherein the winding core is curved along a central arc length (b′) and has an at least approximately constant distance (2D) between long sides thereof and further comprises semicircular end pieces at the end faces thereof.

10. The apparatus recited in claim 7, wherein about $\frac{1}{4}$ of the convex outside of the winding core extending between the end pieces can be covered by the shaped parts of the coil form.

11. The apparatus recited in claim 6, further comprising means for pressing the exposed winding portions of the provisional winding to the concave inside of the winding core, the corresponding outside of said means for pressing having a shape matched to the curvature of the completed winding.

12. The apparatus recited in claim 6, wherein the outside circumference of the provisional winding body is at least approximately equal to the outside circumference of the winding core.

13. The apparatus recited in claim 6, wherein the winding of the magnet coil is made with superconducting conductors.

14. The apparatus recited in claim 6, wherein the magnet coil comprises at least one flat winding.

15. The apparatus recited in claim 6, wherein the magnet coil comprises a plurality of flat windings.

* * * * *